US005288011A

United States Patent [19]

Yoshioka

[11] Patent Number: 5,288,011

[45] Date of Patent: Feb. 22, 1994

[54] PICTURE POST CARD

[75] Inventor: Sadako Yoshioka, Yokohama, Japan

[73] Assignee: Hamada Shashin Kogeisha, Yokohama, Japan

[21] Appl. No.: 13,157

[22] Filed: Feb. 1, 1993

Related U.S. Application Data

[63] Continuation of Ser. No. 662,280, Feb. 28, 1991, abandoned.

[30] Foreign Application Priority Data

Mar. 2, 1990 [JP] Japan ..... 2-20481[U]

[51] Int. Cl.[5] ..... B42D 15/00

[52] U.S. Cl. ..... 229/92.8; 283/110; 283/112

[58] Field of Search ..... 40/156, 158.1

[56] References Cited

U.S. PATENT DOCUMENTS

| | | | |
|---|---|---|---|
| 3,505,140 | 4/1970 | Dunn | 283/109 X |
| 3,802,101 | 4/1974 | Scantlin | 283/110 X |
| 3,875,861 | 4/1975 | Stackig | 229/92.8 X |
| 4,102,312 | 7/1978 | Sashihara et al. | 229/92.8 X |
| 4,125,403 | 11/1978 | Ikenoue et al. | 229/92.8 X |
| 4,144,072 | 3/1979 | Ikenoue et al. | 229/92.8 X |
| 4,170,480 | 10/1979 | Ikenoue et al. | 229/92.8 X |
| 4,267,267 | 5/1981 | Ikenoue et al. | 229/92.8 X |
| 4,469,725 | 9/1984 | Fischer et al. | 283/110 X |
| 4,547,445 | 10/1985 | Asahina et al. | 229/92.8 X |
| 4,801,074 | 1/1989 | Ikeda | 229/71 |
| 4,807,807 | 2/1989 | Glick | 229/92.8 |

FOREIGN PATENT DOCUMENTS

| | | | |
|---|---|---|---|
| 2273730 | 1/1976 | France | 229/92.8 |
| 1294441 | 11/1989 | Japan | 283/109 |

*Primary Examiner*—Allan N. Shoap
*Assistant Examiner*—Jes F. Pascua
*Attorney, Agent, or Firm*—Nikolay Parada

[57] ABSTRACT

A picture post card, which comprises a card body having one surface kept cleared and an opposite surface provided with an image; a translucent hard synthetic resin film laminated on one surface of the card body, enabled for entry of an address and message; and a transparent hard synthetic resin film laminated on said opposite surface of the card body for maintaining quality of the image.

12 Claims, 1 Drawing Sheet

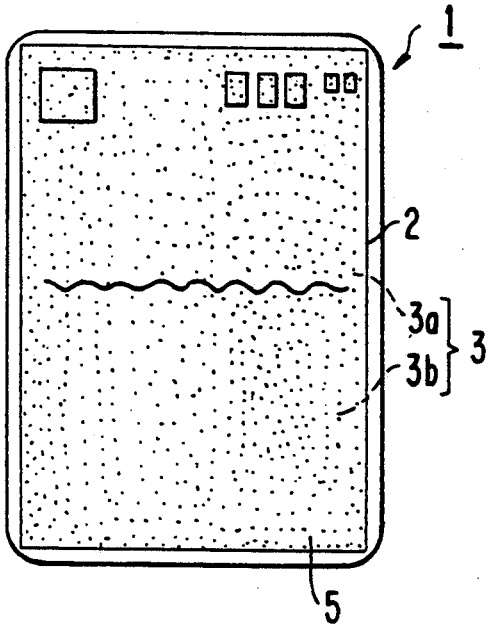
FIG. 1(A)
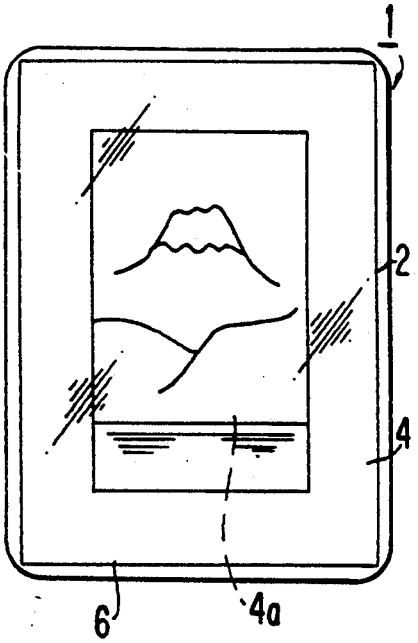
FIG. 1(B)
FIG. 2
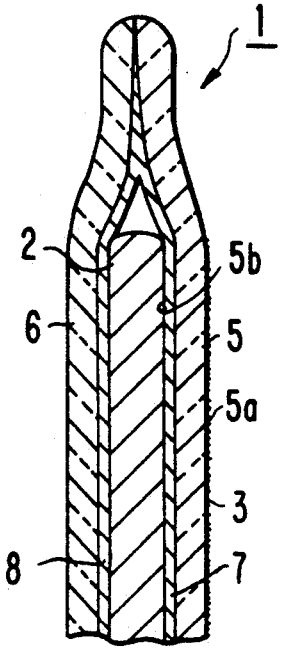

PICTURE POST CARD

This is a continuation application of U.S. application Ser. No. 07/662,280 filed Feb. 28, 1991 now abandoned.

BACKGROUND OF THE INVENTION

1. Field of the Invention

The present invention relates to a picture post card having its both surfaces laminate-packed by a translucent and transparent hard synthetic resin films.

2. Brief Description of the Prior Art

Recently, as a result of developed laminate-packing techniques (sealing by sticking transparent films), the techniques are widely applied to personal certificates, certificates of personal seal impressions, and commutation tickets. However, laminate-packed picture post cards or the like have not yet appeared.

Originally, picture post cards have been used since the end of the 19th century as effective means for introducing the scenery of tourist resorts or shrines and temples or the like.

Because of recent development of camera techniques, everyone can now easily produce so-called illustrative scenery photographs. Furthermore, according to arrangement of roads and improvement of traffic facilities, journeys have become more convenient and easier. Naturally, the role of picture post cards has accordingly varied. The post cards having photographs produced by conventional photographic techniques have become much less interesting to travellers. The recent trend is that post cards having more artistically valuable high grade photographs are desired.

A card having such an excellent image often serves as a conveyer of the sender's sentiments caused by the journey, or as an addition to an interior of a room when it is attached to the wall.

SUMMARY OF THE INVENTION

The present invention provides a picture post card having one surface thereof laminated by a hard synthetic resin film having a translucent, that is, mat-processed external surface so that an address and a message can be easily entered by a ball-point pen or pencil. The opposite surface is also laminated by a hard synthetic resin film, which is transparent so that an image such as a photograph or a picture provided on the card body can be viewed through the film and protected from the external conditions.

An object of the present invention is to provide a picture post card, from which one can not easily remove the attached stamp, the address or message on which are easily entered and not distinguished, the quality of the card does not deteriorate, and which is durable against long time display and preservation.

Another object of the present invention is to provide a picture post card having a translucent surface, on which stamps are firmly sticked and message can be also easily entered.

Further object of the present invention is to provide a picture post card having an opposite surface, on which a clear and excellent image is produced.

Still further object of the present invention is to provide a picture post card which is protected from the external conditions and according, is free from deformation or discoloration.

Still further object of the present invention is to provide a picture post card having one surface laminated by a translucent film and the other surface laminated by a transparent film, so that an address or the like can be entered and stamps can be attached on one surface thereof.

BRIEF DESCRIPTION OF THE DRAWINGS

FIG. 1(A) is a plan view illustrating one surface of a picture post card according to the present invention, and FIG. 1(B) is a plan view illustrating an opposite surface of the card; and FIG. 2 is a sectional view illustrating an edge portion of the card.

DETAILED DESCRIPTION OF THE PREFERRED EMBODIMENTS

Preferred embodiments according to the invention will now be described with reference to the accompanying drawings.

FIG. 1(A) represents first surface and FIG. 1(B) represents the opposite surface of an embodiment of a picture post card according to the invention. FIG. 2 is a sectional view illustrating an edge potion of the card.

The card 1 is formed of a card body 2, on first surface of which a 50 micron mat-processed polyester film 5 is laminated. Further, on the other surface, a 50 micron non-matted polyester film 6 is laminated. As a result, a laminate-packed, sealed card 1 is formed.

More precisely, first surface 3 of the card 1 for entering an address 3*a* and a message 3*b* is attached to a translucent film 5, whose external translucent surface is outside and the transparent internal surface faces the surface 3 through an adhesive layer 7.

On the other hand, the opposite surface 4, on which an image such as a photograph or picture is printed, is attached to a transparent film 6, which has an adhesive layer 8 of the same kind as the layer 7 above. Then, the film 5, card body 2 and film 6 are pressed and fused together to form a card 1.

To the card formed by the process stated above, a stamp can be attached to its translucent side 5*a* of the surface 3, and an address and message can be entered by a ball-point pen or pencil on the address space 3*a* message space 3*b*, so the card is suitable to be mailed as a post card.

The image 4*a*, which is formed on the opposite surface 4 and viewed through transparent film 6, is clearly visible is attractive exhibits artistic appearance, and is also free from discoloration.

Films 5 and 6 also prevent the card body 2 from being deformed.

What is claimed is:

1. A picture post card having a surface for entry of an address and a message and an opposite surface provided with an image comprising:

a card body having a first surface and a second surface, said second surface being provided with an image;

a translucent hard synthetic resin film laminated on said first surface of said card body, said translucent resin film having a mat-processed external surface on which one can enter a message and an address using writing utensils, said external surface being the surface of said translucent resin film itself, and a transparent hard synthetic resin film laminated on said second surface of said card body.

2. A picture post card according to claim 1, wherein said translucent and transparent hard synthetic resin films are attached to each surface of said card body through an adhesive layer, respectively.

3. A picture post card according to claim 2, wherein said translucent and transparent hard synthetic resin films are of polyester of about 50 micron in thickness.

4. A picture postcard according to claim 1, wherein said image is a photograph.

5. A picture postcard according to claim 1, wherein said first surface of said card body has a printed indicia, said indicia being visible through said translucent hard resin film.

6. A picture post card having a surface for entry of an address and a message and an opposite surface provided with an image comprising:

a card body having a first surface and a second surface, said second surface being provided with an image and said first surface having an indicia;

a translucent hard synthetic resin film laminated on said first surface of said card body, said translucent resin film having a mat-processed external surface on which one can enter a message and an address using writing utensils, said external surface being the surface of said translucent resin film itself, wherein said translucent hard synthetic resin film allows to see said indicia on said first surface of said card body by the naked eye, and a transparent hard synthetic resin film laminated on said second surface of said card body.

7. A picture postcard of claim 6, wherein said indicia includes an information related to said image.

8. A picture postcard of claim 7, wherein said image is a photograph.

9. A picture postcard of claim 6, wherein said indicia is postal indicia.

10. A picture postcard of claim 9, wherein said postal indicia includes a first marking designating places for writing a message and an address, and a second marking designating a place for a stamp.

11. A picture postcard of claim 9, wherein said image is a photograph.

12. A picture postcard of claim 6, wherein said image is a photograph.

* * * * *